United States Patent [19]

Forster

[11] Patent Number: 4,896,585

[45] Date of Patent: Jan. 30, 1990

[54] ADJUSTABLE AXIAL PISTON MACHINE

[75] Inventor: Franz Forster, Muhlbach, Fed. Rep. of Germany

[73] Assignee: Linde Aktiengesellschaft, Wiesbaden, Fed. Rep. of Germany

[21] Appl. No.: 187,388

[22] Filed: Apr. 28, 1988

[30] Foreign Application Priority Data

May 5, 1987 [DE] Fed. Rep. of Germany ..... 3714888

[51] Int. Cl.[4] ..... F01B 3/00/13/04

[52] U.S. Cl. ..... 92/12.2; 92/13.1; 92/57; 92/71; 91/505; 91/506; 74/60

[58] Field of Search ..... 92/12.2, 13, 13.1, 13.8, 92/57, 150, 151, 71, 147, 72; 91/505, 506; 417/222; 74/60

[56] References Cited

U.S. PATENT DOCUMENTS

| | | | |
|---|---|---|---|
| 2,722,889 | 11/1955 | Wahlmark | 91/506 |
| 3,834,281 | 9/1974 | Heyl et al. | 91/506 |
| 4,030,404 | 6/1977 | Meijer | 92/13.1 |
| 4,205,590 | 6/1980 | Stegner | 91/506 |
| 4,543,876 | 10/1985 | Heyl et al. | 91/506 |

FOREIGN PATENT DOCUMENTS

| | | | |
|---|---|---|---|
| 2037635 | 2/1972 | Fed. Rep. of Germany | 91/506 |
| 2620523 | 12/1977 | Fed. Rep. of Germany | 91/506 |

*Primary Examiner*—Robert E. Garrett
*Assistant Examiner*—Thomas E. Denion
*Attorney, Agent, or Firm*—Thomas R. Shaffer

[57] ABSTRACT

An adjustable axial piston machine is disclosed which has a housing, a cylinder drum and an operating cylinder-servo piston unit capable of being acted upon by control pressure. The cylinder-servo piston unit has a movable part which is being connected with a control of the axial piston machine. The operating cylinder-servo piston unit has an annular configuration and is located around the cylindrical drum.

4 Claims, 2 Drawing Sheets

ADJUSTABLE AXIAL PISTON MACHINE

BACKGROUND OF THE INVENTION

The present invention relates to an adjustable axial piston machine. More specifically, it relates to an adjustable axial piston machine having an annular operating cylinder located around the cylinder drum.

SUMMARY OF THE INVENTION

The invention proposes to develop a control for such an axial piston machine so that the total structural volume of the axial piston machine is as small as possible, where the surface of the regulating piston is to be as large as possible so that it can be operated with a low control pressure.

This problem is solved according to the invention in that the operating cylinder-servo piston unit is annular and is arranged around the cylinder drum, i.e., inside of a cylindrical space coaxial to the axis of rotation of the cylinder drum. The result is that the radial extent of the operating cylinder-servo piston unit only has to be relatively small, so that the outside dimensions of the axial piston machine housing can be kept small. Due to the arrangement in a relatively large radius, the servo piston annular surface has a great length and thus requires only a relatively small width in order to furnish a large piston surface. A large piston surface makes it possible to generate the adjusting forces required with a slight control pressure.

A particularly expedient implementation form results if the annular space of the operating cylinder is limited outward by the inside wall of the housing hole, in which case the inner wall of the annular space of the operating cylinder is formed of the outside wall of a displaceable cylindrical sleeve that is connected by means of an extending component with a journal that is located on the rocker of the axial piston machine that forms the control, in which case the sleeve has a ring at its outer side that lies in a sliding manner with its cylindrical end surface against the inner wall of the housing hole and which forms the piston surface with its plane surface. This ring can consist of one piece with the sleeve. So long as a satisfactory sealing solution can be found, this ring can consist of a spring expanding ring that is inserted into a groove of the sleeve so that less machining work is required.

As is known, a space can be provided opposite the cylinder pressure space, in which a pressure spring is located.

So that the housing hole can extend inward up to the end of the housing jacket, a sealing ring can be inserted into the back region in the space between the inner wall of the housing hole and the outer wall of the sleeve, which has an end surface that matches the effective piston surface and which can in turn be supported against the control bottom part of the axial piston machine.

The invention is elucidated in greater detail on the basis of the implementation examples shown in the drawing.

DETAILED DESCRIPTION OF THE PREFERRED EMBODIMENT

Figure 1:
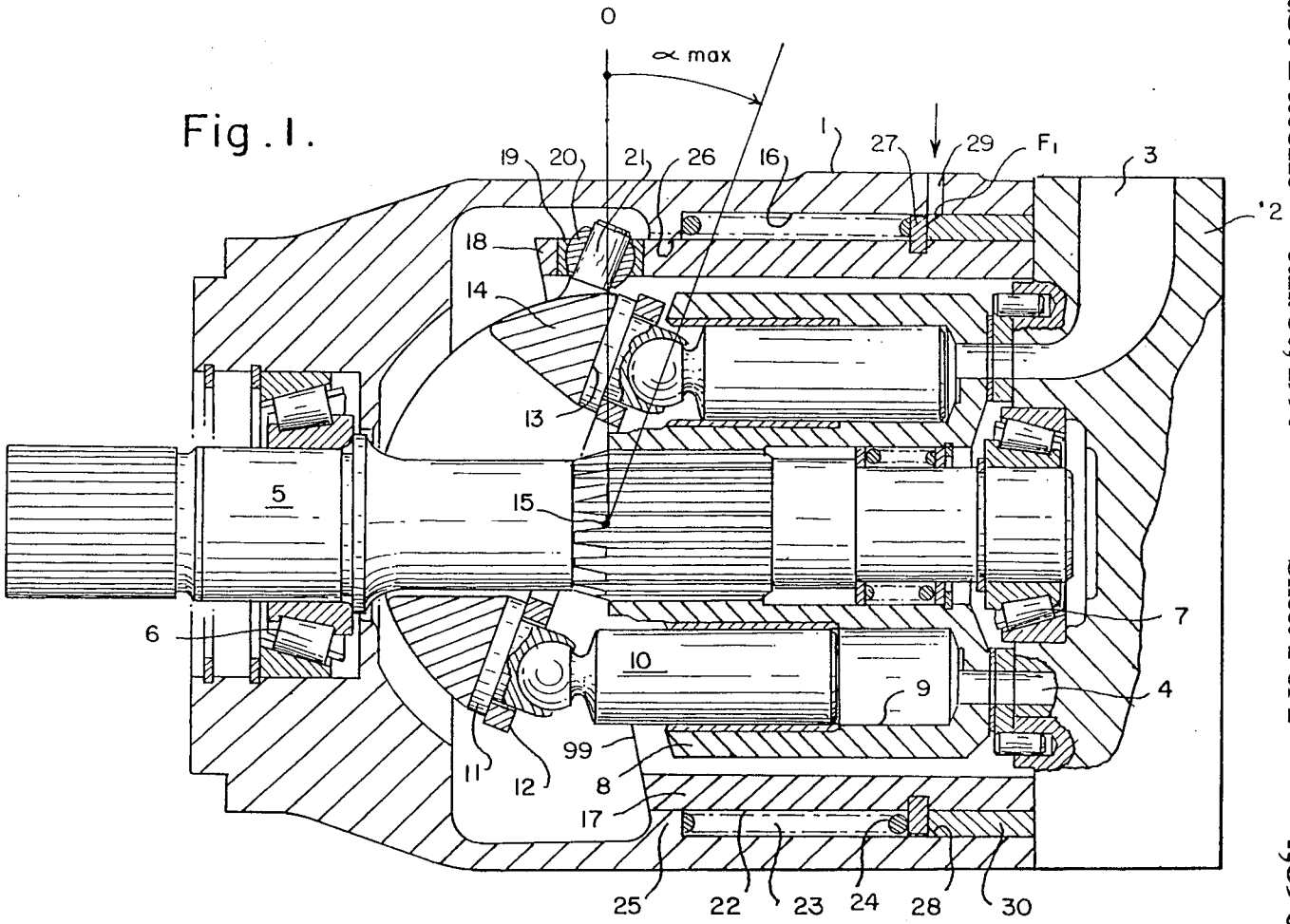
FIG. 1 shows an axial piston machine that can be swung only in one direction, according to the invention and in axial section.

The housing 1 is connected with the control bottom part 2 (in a manner not shown in the drawing), in which two fluid channels 3 and 4 are located. The shaft 5 is supported by a roller bearing 6 in the housing 1 and by a roller bearing 7 in the control bottom part 2. The cylindrical drum 8 is connected in a rotation-proof manner with the shaft 5. Cylindrical holes 9 are provided in the cylindrical drum and a piston 10 is capable of sliding in each of these cylindrical holes 9; the piston 10 is supported through a sliding shoe 11 against a swash plate surface 13. The sliding shoes 11 are held in position on the swash plate surface 13 by a hold-down plate 12. The swash plate surface 13 is capable of swinging on a pivot axis 15 that is normal to the plane of the drawing and intersects the axis of the shaft 5.

The housing 1 has an inner hole 16, inside of which a sleeve 17, which has an extending part 18, is supported in a sliding manner. A ring 19 is supported in a hole of this extending part 18 and it has an inner spherical surface, inside of which a ball 20 is supported. This ball 20 in turn has a hole through which the journal 21, which is connected solidly with the rocker 14, extends.

The outer wall 22 of the sleeve 17 is arranged at a distance from the inner wall 16 of the housing hole so that an annular space 23 is formed between these two walls. A spring 24 is located in this annular space 23. The annular space 23 is limited on the shaft side by a housing projection 25 that has an inner cylindrical surface 26, against which the outer wall of the sleeve 17 lies. A ring 27 is located on the outside wall of the sleeve 17; it lies with its end face against the inner wall 16 of the hole and is also supported against the spring 24. The space 23 is connected through the holes lying outside of the drawing plane with the space in which the rocker 14 is located.

A space 28 corresponding to the space 23 is formed between the outer wall of the sleeve 17 and the inner wall of the housing hole 16 on the side of the ring 27 that faces the control bottom. A hole 29 is connected to this space 28. The space 28 is sealed toward the control bottom part 2 by a sealing ring 30, which also serves as a stop for the ring 27.

The mode of operation is as follows: if pressure medium is introduced through the hole 29 into the space 28, the pressure of this medium acts on the annular surface of the ring 27 and thus exerts a force that shifts the ring 27 and thus the sleeve 17 toward the left in the drawing, with the result that the rocker 14 is swung counterclockwise over the recess part 18 and the joint 19, 20, 21. The ring 27 is displaced against the force of the spring 24 so that when the pressure in the hole 29 is relieved, the sleeve 17 again shifts toward the right in the drawing.

Figure 2:
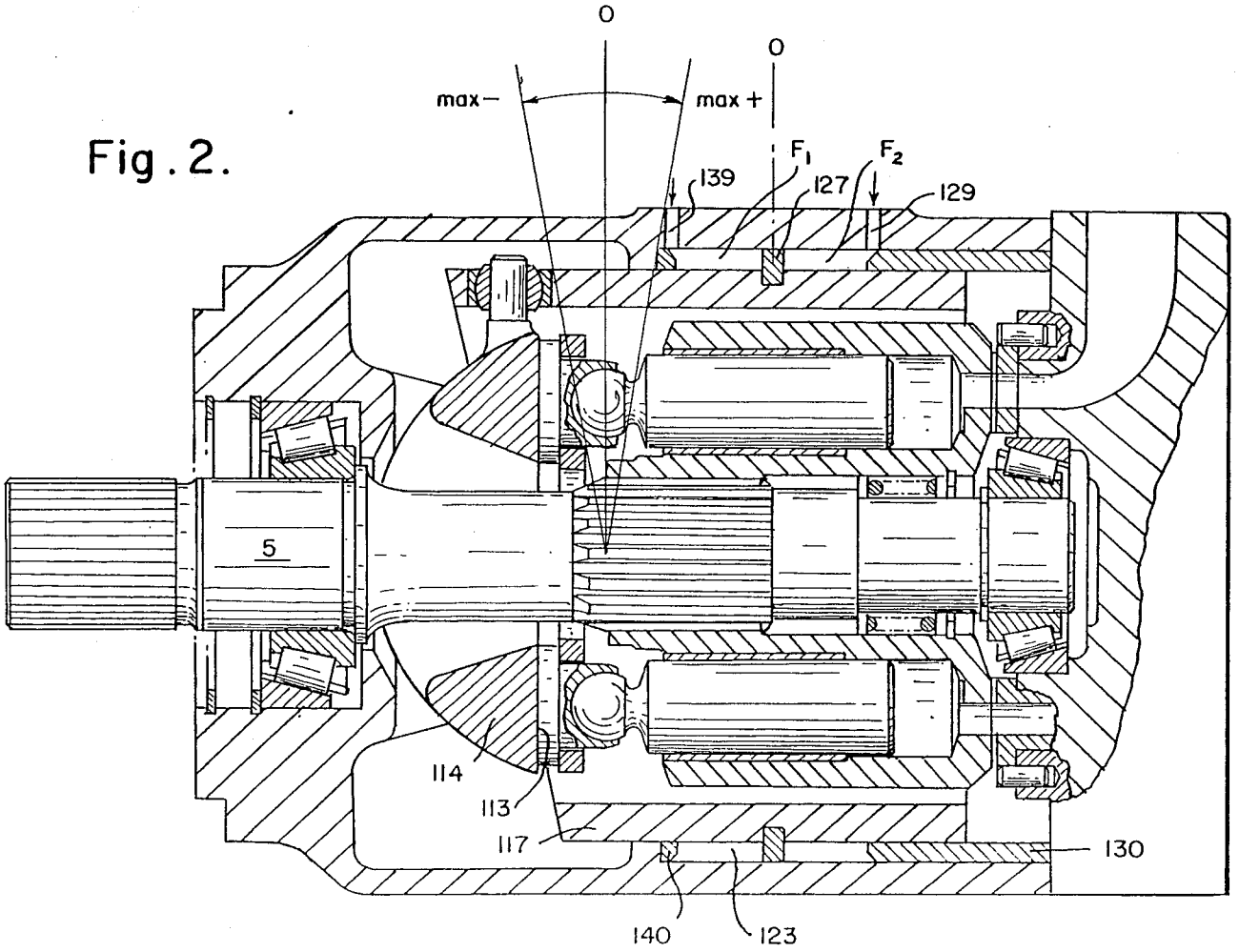
FIG. 2 shows an axial piston machine capable of swinging in both directions from the neutral position, according to the invention and in axial section.

The implementation example according to FIG. 2 differs from that according to FIG. 1 only in the correlation of the dimensions, such that in the depicted position the swash plate surface 113 assumes its position normal to the axis of the shaft 5, with the result that in this position the ring 127 does not lie against a stop, but is in the middle of its displacement path. Outside of the hole 129, a second hole 139 is provided in this case and the annular space 123 is not connected through holes with the space in which the rocker 114 is located, but rather is provided with a second sealing ring 140.

If necessary, springs are located in the annular spaces on both sides of the ring 127.

Although the adjusting force engages strongly on the piston away from the center, a canting or tilting due to the great guide length of the tubular sleeve carrying the piston 27 or 127 need not be feared. None of the components of the control device rotates with the cylindrical drum, although these components are arranged coaxially to the cylindrical drum. The breakdown of the components of the control device also facilitates a constraint-free operation even if the inner sleeve 17 is heated more strongly than the housing 1. In the case of a constant swash plate motor, a disk brake located in the peripheral space around the cylindrical drum can be installed in a housing with identical outside dimensions.

For a favorable common design of the sleeve 17 and its extending part 18 it is provided that the sleeve 17 ends in an obliquely cut surface 99 on the rocker side. The ring 27 can, for example, be a spring expanding ring, a play-free ground piston ring or a set of play-free ground piston rings or can be a wound groove ring, e.g., of a plastic such as that known by the trade name Teflon.

While certain presently preferred embodiments of the invention have been described above, it is to be distinctly understood that the invention is not limited thereto and may be otherwise variously practiced within the scope of the following claims.

I claim:

1. An adjustable axial piston machine having a housing, a rotating cylinder drum and an operating cylinder-servo piston unit capable of being acted upon by control pressure of low pressure, said cylinder-servo piston unit having a non-rotatable movable part being connected with a control of the axial piston machine having an annular configuration and being located around the cylinder drum.

2. An adjustable axial piston machine having a housing, a rotating cylinder drum and an operating cylinder-servo piston unit capable of being acted upon by control pressure of low pressure, said cylinder-servo piston unit having a non-rotatable movable part being connected with a control of the axial piston machine having an annular configuration and being located around the cylinder drum, wherein the operating cylinder has an annular space therein, an outside wall of said annular space being formed by a wall of a hole provided in said housing and the inner wall thereof being formed by an outside wall of a displaceable non-rotating cylinder sleeve, said sleeve being connected by means of an extending part with a pull-in-step journal to a rocker, said piston machine further comprising a ring stand outward, forming a piston said ring having an outer edge lying on the wall of the hole in said housing and said ring having an inner edge connected with the sleeve.

3. Axial piston machine according to claim 2, wherein the hole in the housing passes through a control bottom side and further comprising a sealing ring located in the region of the control bottom between the outside wall of the sleeve and the wall of the housing hole, said sealing ring being supported against a control bottom part.

4. Axial piston machine according to claim 2, wherein said ring is a spring ring inserted into a groove provided in the sleeve.

* * * * *